US008152607B2

(12) United States Patent
Carrig

(10) Patent No.: US 8,152,607 B2
(45) Date of Patent: Apr. 10, 2012

(54) PORTABLE WORK STATION

(76) Inventor: Daniel J. Carrig, Omaha, NE (US)

( * ) Notice: Subject to any disclaimer, the term of this patent is extended or adjusted under 35 U.S.C. 154(b) by 1091 days.

(21) Appl. No.: 11/977,632

(22) Filed: Oct. 25, 2007

(65) Prior Publication Data

US 2009/0111369 A1 Apr. 30, 2009

(51) Int. Cl.
*F24F 7/00* (2006.01)

(52) U.S. Cl. ..... 454/63; 454/49

(58) Field of Classification Search ..... 454/49, 454/50, 63, 64, 65, 51, 52, 53, 54, 55, 56; 55/356

See application file for complete search history.

(56) References Cited

U.S. PATENT DOCUMENTS

| | | | | |
|---|---|---|---|---|
| 4,682,448 | A * | 7/1987 | Healey | 52/63 |
| 5,230,723 | A * | 7/1993 | Travis et al. | 96/57 |
| 5,312,465 | A * | 5/1994 | Riutta | 55/320 |
| 5,487,766 | A | 1/1996 | Vannier | |
| D378,125 | S | 2/1997 | Vannier | |
| 6,099,607 | A * | 8/2000 | Haslebacher | 55/356 |
| 6,632,260 | B1 * | 10/2003 | Siemers et al. | 55/385.2 |
| 7,037,359 | B1 * | 5/2006 | McCauley | 95/141 |
| 2002/0043056 | A1 * | 4/2002 | Cheng | 55/385.1 |
| 2006/0107987 | A1 * | 5/2006 | Chen et al. | 136/205 |

OTHER PUBLICATIONS

Mobile Prep Station. Automotive Body Repairs News, Feb. 2006, vol. 45 Issue 2, p. 66-66 p. 1/4.*

Automotive Nody Repair News. Cleveland: Jan. 2006. vol. 45, Iss 1; p. 68, 7pgs.*

* cited by examiner

*Primary Examiner* — Steven B McAllister
*Assistant Examiner* — Brittany E Towns
(74) *Attorney, Agent, or Firm* — Dennis L. Thomte; Thomte Patent Law Office LLC

(57) ABSTRACT

A portable work station including a main housing, a fan and motor housing, transition housing and an exhaust housing with the housings being selectively removably secured together rather than being welded as in the prior art. The work station includes a ballast compartment in the main housing into which ballast material may be placed to stabilize the work station. The work station includes supports for the framework of a drape assembly with the supports being selectively removably secured to the main housing.

10 Claims, 4 Drawing Sheets

PORTABLE WORK STATION

BACKGROUND OF THE INVENTION

1. Field of the Invention

This invention relates to a portable paint station or work station which is adapted to remove particulate and/or other airborne contaminates, including odors and volatile organic compounds, from the air of a work area, and more particularly to an improved portable work or paint station which represents: an improvement over Assignee's U.S. Pat. No. 5,487,766 and U.S. Design Pat. No. 378,125.

2. Description of the Related Art

Various systems have been utilized for handling and treating an airstream containing particulates from spray paint or the like. For example, U.S. Pat. No. 3,395,972 describes a system for cleaning the air of dust and noxious fumes in a spray paint booth. A mobile air cleaning apparatus is disclosed in U.S. Pat. No. 4,909,815 which provides a base with an intake vent in the upper surface, and an exhaust vent positioned over the base, such that a vehicle being painted may be positioned between the base and overhanging exhaust vent.

The Assignee of the instant invention owns U.S. Pat. No. 5,487,766 and U.S. Design Pat. No. 378,125 which are believed to represent distinct improvements in the portable paint and work stations of the prior art. In particular, the instant invention incorporates some of the features of U.S. Design Pat. No. 378,125. The portable paint station disclosed in U.S. Design Pat. No. 378,125 does work extremely well. The portable paint station of the design patent is also used to support a drape assembly movably positioned on a framework which is secured to the main housing so as to be able to provide an enclosed work area for the paint or work station. The portable paint station of U.S. Design Pat. No. 378,125 is provided with a fan and motor housing, the lower end of which is welded to the top wall of a main housing. If an alternative motor and fan assembly is required, an entire new station must be provided due to the motor and fan housing being welded to the main housing. Second, the work station of the design patent is somewhat top-heavy and the work station of the design patent does not have a convenient means for adding ballast to the station to prevent the same from overturning. Third, the portable paint station of the design patent does not include a removable support system for supporting the framework of the drape assembly. The same is also true for the work station presently being marketed by the assignee of this invention, namely Shop-Pro Equipment, Inc., 13520 Giles Road, Suite A, Omaha, Nebr. 68138. In some cases, the work station will not be used in conjunction with a drape assembly but the drape assembly support system for the work station is welded thereto which means that extra equipment will be included on all work stations regardless of the need therefore.

SUMMARY OF THE INVENTION

A portable work station comprising a main housing, a fan and motor housing secured to the upper end thereof, a transition housing secured to the upper end of the motor and fan housing and an exhaust housing secured to the upper end of the transition housing. In the instant invention, the lower end of the fan and motor housing is selectively removably secured to the main housing and has its upper end selectively removably secured to the lower end of the transition housing. The upper end of the transition housing is selectively removably secured to the lower end of the exhaust housing so that if an alternative larger fan and motor housing is required, a substitute fan and motor housing and different transition housing may be positioned between the main housing and the lower end of the exhaust housing.

The main housing includes an air flow compartment and a ballast compartment with the ballast compartment being accessible from the rear of the main housing. Ballast material, such as bags of utility sand, is placed in the ballast compartment to stabilize the work station. The support system for the drape assembly framework is selectively removably secured to the main housing so that if the work station is to be used without a drape assembly, the supports for the framework of the drape assembly are omitted from the work station since they are selectively removably secured to the main housing of the work station.

It is therefore a principal object of the invention to provide an improved portable work station.

A further object of the invention is to provide a portable work station including a ballast compartment in the main housing thereof which is adapted for easy placement or removal of ballast material necessary therein to stabilize the work station.

A further object of the invention is to provide an improved portable work station wherein motor and fan housings of different dimensions may be substituted or interchanged with the original model due to the fact that the housings of the work station are selectively removably secured together rather than being welded together.

A further object of the invention is to provide a portable work station including a support assembly for the framework of a drapery enclosure assembly with the support assembly being selectively removably secured to the main housing of the work station.

These and other objects will be apparent to those skilled in the art.

DETAILED DESCRIPTION OF THE INVENTION

Figure 1:
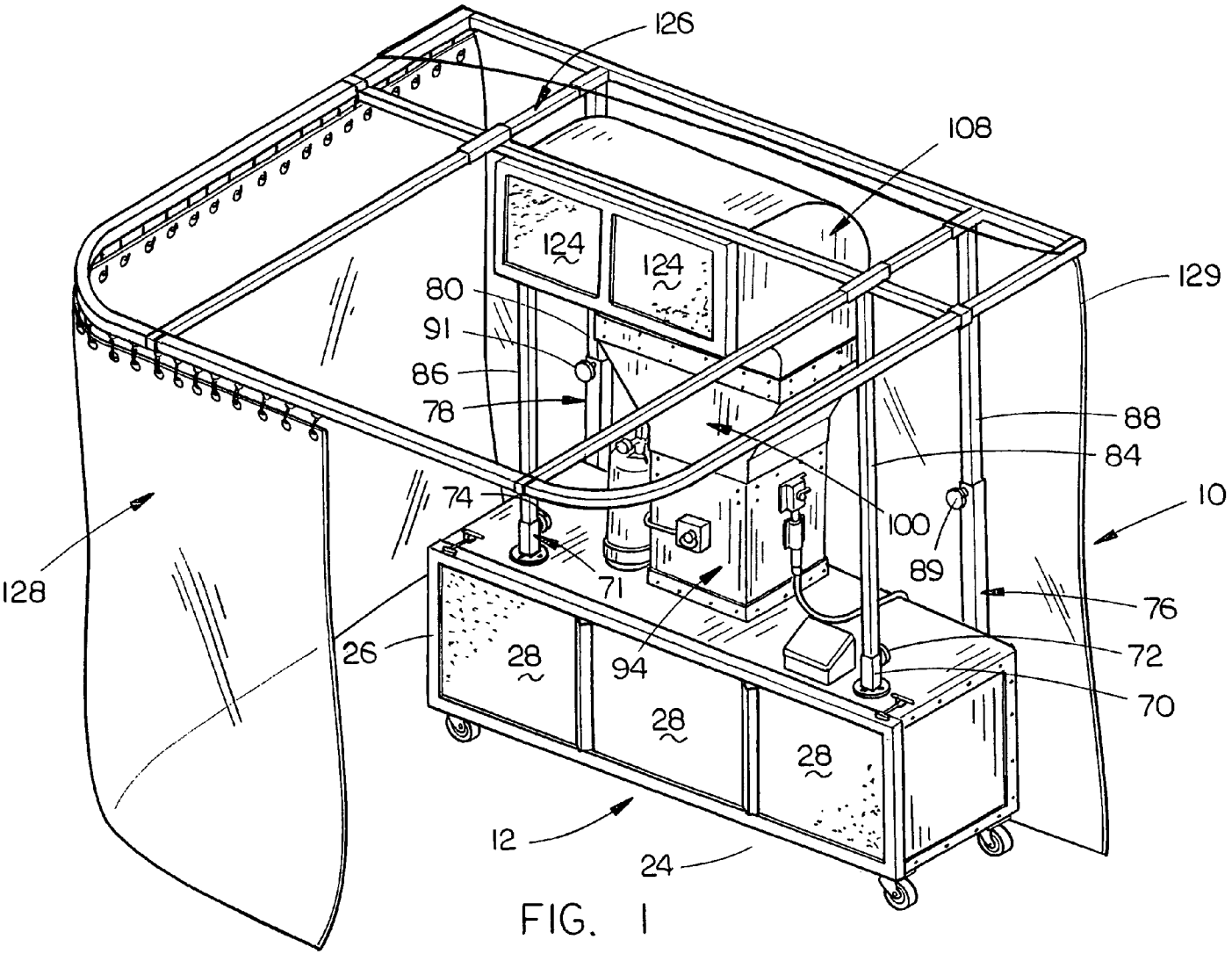
FIG. 1 is a perspective view of the portable work station of this invention with the drapery enclosure assembly thereof being partially shown.
Figure 2:
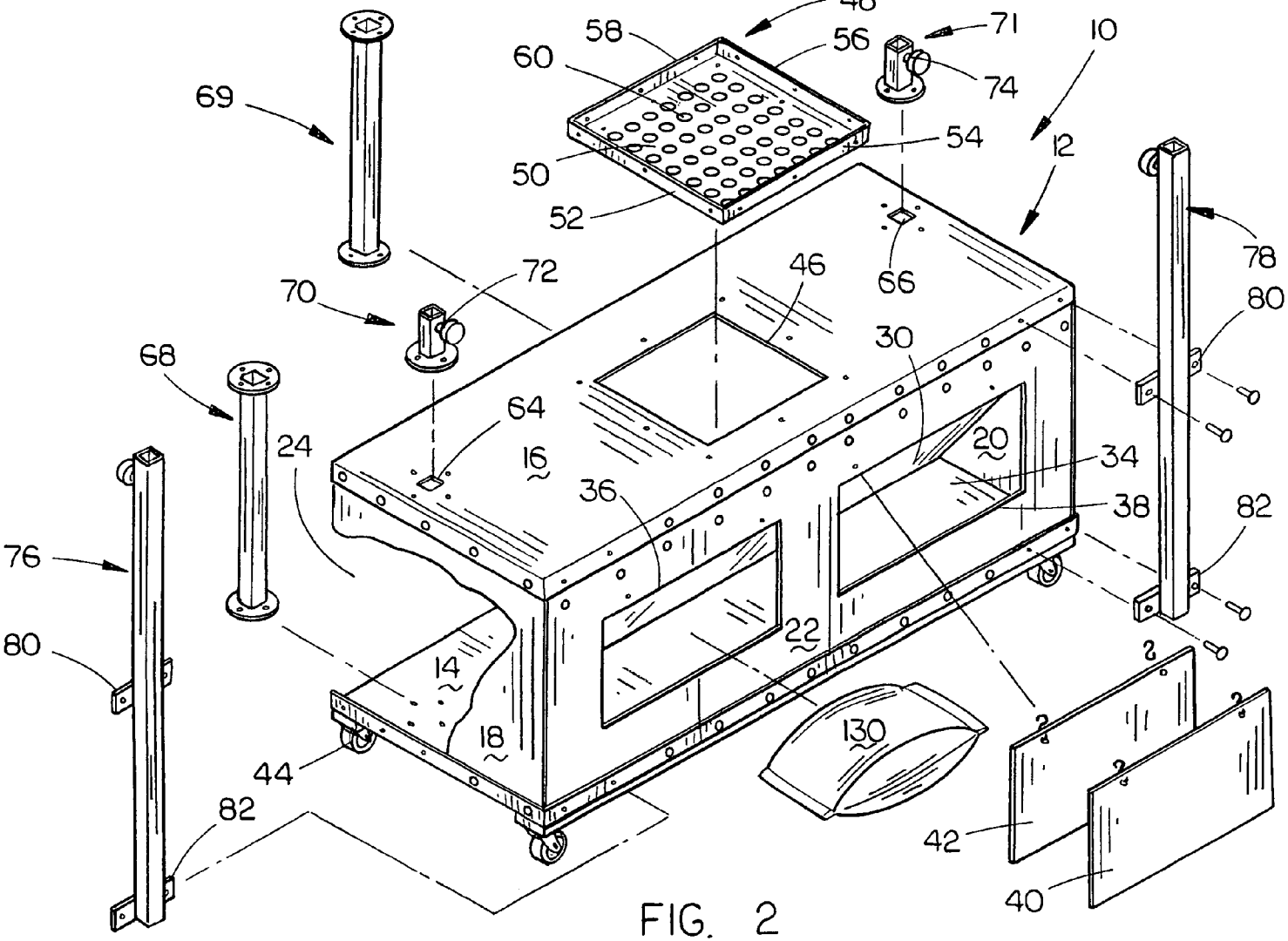
FIG. 2 is an exploded perspective rear view of the main housing portion of the portable work station of this invention.
Figure 3:
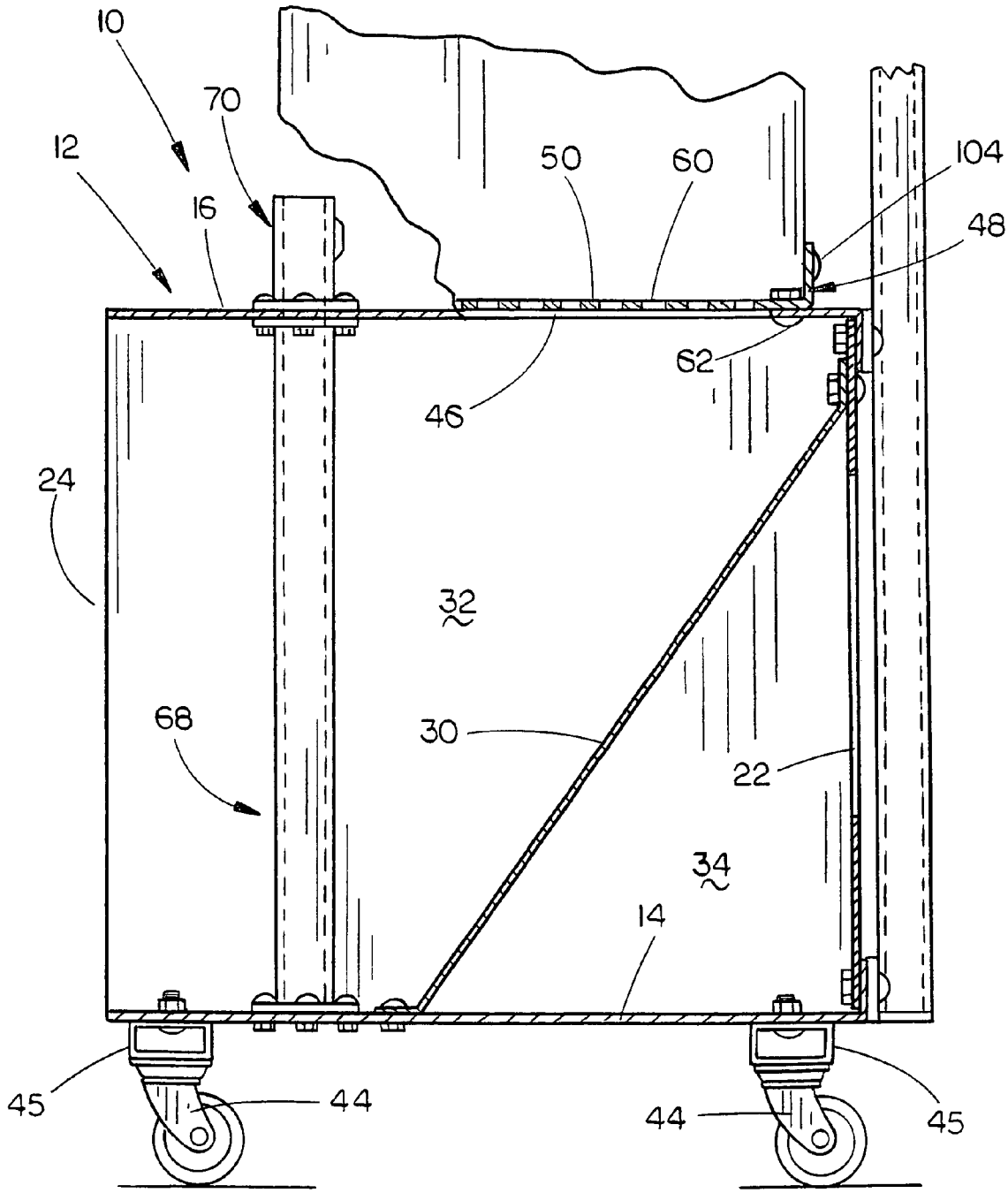
FIG. 3 is a sectional side view of the main housing.
Figure 4:
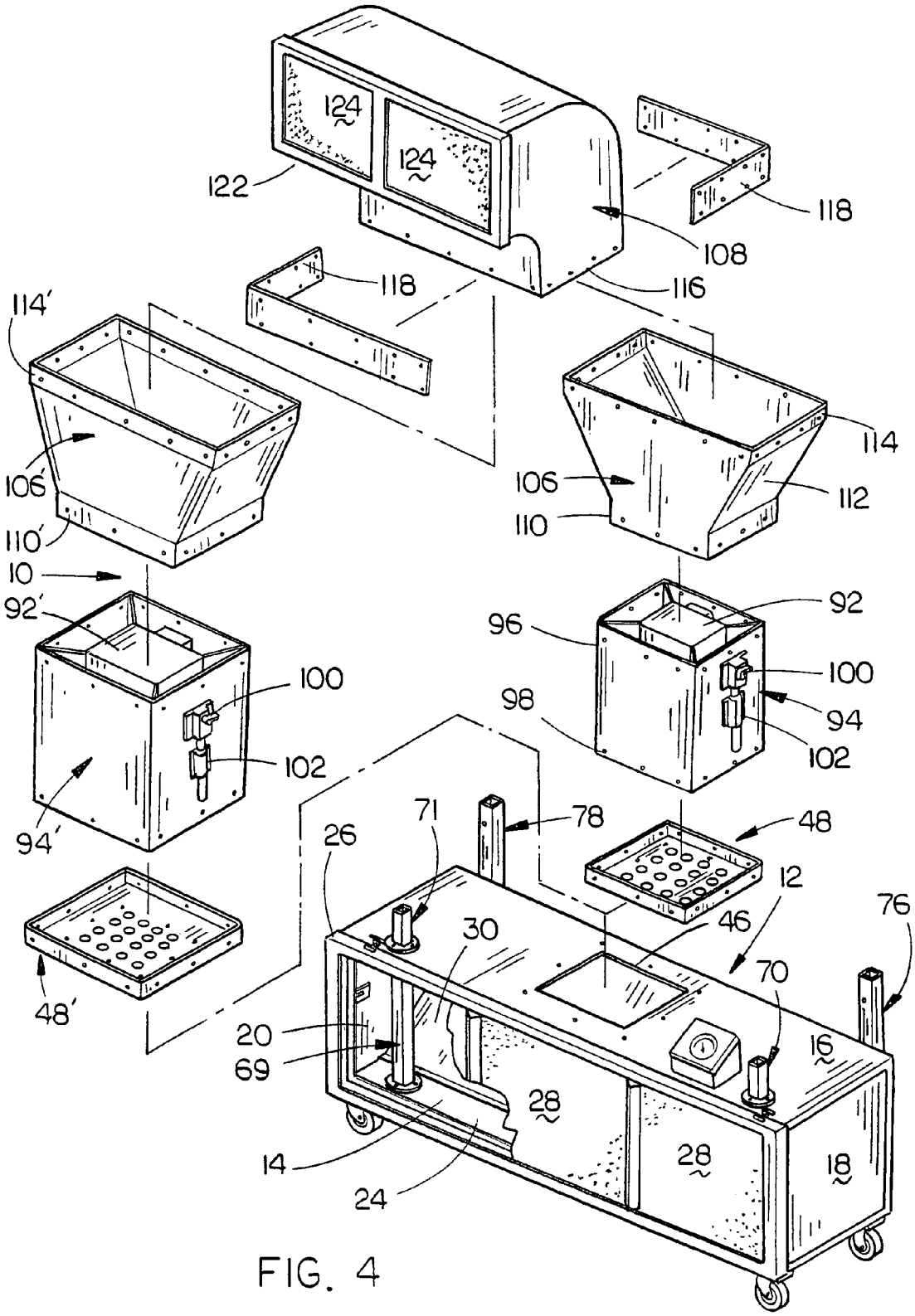
FIG. 4 is an exploded perspective view of the portable work station.

The portable work station of this invention is referred to generally by the reference numeral 10. Station 10 includes a main housing assembly 12 having a bottom wall 14, a top wall 16, end walls 18 and 20, back wall 22, an open front inlet 24 opposite to back wall 22, and a main filter lid 26 pivotally secured at its lower end to the bottom wall 14 which is movable between open and closed positions. Lid 26 is adapted to have conventional filters 28 secured into place by adjustable filter racks to accommodate alternative filter combinations positioned inwardly thereof.

A diagonally extending wall member 30 is positioned within the interior of housing 12 and is secured thereto to define an inlet air compartment 32 and a ballast compartment 34. Ballast compartment 34 is accessible by means of a pair of openings 36 and 38 formed in back wall 22 which are selectively closed by covers 40 and 42, respectively.

Four swivel caster wheels 44, with locks, are secured to support channels 45 which are secured to bottom wall 14 at the corners thereof to enable the work station to be easily moved from location to location and locked in placed in the desired location. The support channels 45 are bolted to bottom wall 14. The channels 45 may be removed so the base unit can be mounted to alternative support structures, i.e., lifting platform, forklift ports, trailer, etc. An air discharge opening 46 is formed in top wall 16. The numeral 48 refers to a mounting frame having a horizontally disposed base portion 50 having upturned portions 52, 54, 56 and 58 at the perimeter thereof. The central part of base portion 50 has a plurality of spaced-apart openings 60 formed therein which are positioned over the opening 46 in top wall 16 of housing 12. The mounting frame 48 is removably secured to top wall 16 by bolts or screws 62. The numeral 48' refers to a mounting frame which may be substituted for mounting frame 48 and which is of alternative sizes than mounting frame 48, as will be described hereinafter.

Top wall 16 is provided with a pair of spaced-apart openings 64 and 66 formed therein adjacent the front corners thereof. Support tubes 68 and 69 are positioned within air inlet compartment 32 below the openings 64 and 66 with the bottom flanges thereof being bolted to bottom wall 14 and the upper flanges thereof being positioned below top wall 16. Sockets 70 and 71 are positioned on the upper surface of top wall 16 over openings 64 and 66, respectively, with the flanges thereof being bolted to top wall 16 and the upper flanges of tubes 68 and 69, respectively. Locking bolts 72 and 74 threadably extend inwardly through sockets 70 and 71, respectively.

Support tubes 76 and 78 are positioned at the outer surface of back wall 22 adjacent end walls 18 and 20 and are each removably secured thereto by upper and lower brackets 80 and 82, respectively, which are welded to each of the tubes 76 and 78 and which are selectively bolted to the back wall 22.

Drape support post 84 removably extends downwardly through socket 70, opening 64 and tube 68 and is selectively held therein by locking bolt 72. Drape support post 86 removably extends downwardly through socket 71, opening 66 and tube 69 and is selectively held therein by locking bolt 74. Drape support post 88 removably extends downwardly through support tube 76 to the closed lower end thereof and is held therein by a locking bolt threadably extending through the upper end of tube 76. Drape support post 90 removably extends downwardly through support tube 78 to the closed lower end thereof and is held therein by a locking bolt threadably extending inwardly through the upper end of tube 78.

A conventional motor/fan assembly 92 is positioned in a vertically disposed housing 94 which has an upper end 96 and a lower end 98. A conventional explosion proof control switch 100 and a conventional explosion proof receptacle 102 are provided on the housing 94 of assembly 92. The lower end 98 of housing 94 is received by the upturned portions 52, 54, 56 and 58 of base portion 50 of frame 48 and is removably secured thereto by screws 104 extending therethrough. The numeral 92' refers to a motor/fan assembly which may be substituted for assembly 92 when an alternative motor/fan assembly is desired. When motor/fan assembly 92' is utilized, mounting frame 48' will be used in place of mounting frame 48.

The numeral 106 designates a transition housing which is secured to and positioned between the upper end of housing 94 and exhaust housing 108. Transition housing 106 includes a lower end portion 110, a tapered intermediate portion 112 and an upper end portion 114. Lower end portion 110 of housing 106 is received by the upper end 96 of housing 94 and is removably secured thereto by bolts or screws.

Exhaust housing 108 includes a lower end 116 which has the same dimensions as the upper end 114 of transition housing 106 and which is removably secured thereto by plates 118 and screws or bolts 120. The open forward end of exhaust outlet 122 of housing 108 has filters 124 secured into place by adjustable filter racks to accommodate alternative filter combinations mounted therein by any convenient means. The numeral 106' refers to another transition housing which will be utilized when the larger housing 94' is used on the station 10. The lower end 110' of housing 106' is sized so as to be received within and secured to the upper end of housing 94'. The upper end 114' of housing 106' has the same dimensions as the upper end 114 of housing 106 so as to be secured to exhaust housing 108.

A drape support framework 126 is removably mounted on the upper ends of drape support posts 84, 86, 88 and 90 for movably supporting a large drape assembly 129 and sliding drapery curtains 128 thereon to provide an enclosure for sanding, painting, welding, etc.

There are at least three improvements incorporated into the instant invention over the prior art work station previously offered by the assignee of this invention. The first improvement is that the instant invention is more stable than the prior art device through the provision of ballast being positioned in ballast compartment 34. It is recommended that three hundred pounds of ballast material such as five 60-pound bags of utility sand by placed in the ballast compartment 34 which stabilizes the station since it could potentially be "top-heavy."

Second, in those situations where a drape assembly is not going to be used with the work station, the following components are omitted from the work station to reduce the cost thereof: openings 64, 66; support tubes 68, 69; sockets 70, 71; support tubes 76, 78; locking bolts 72, 74, 89 and 91; drape support posts 84, 86, 88 and 90; drape support framework 126; drape assembly 129; and sliding drapery curtains 128.

Third, in those situations where an alternative motor/fan assembly is desired, housing 94 and transition housing 106 are easily replaced with the housing 94' and transition housing 106'.

Thus it can be seen that the invention accomplishes at least all of its stated objectives.

I claim:

1. A portable work station, comprising:

a main housing having a bottom wall, a top wall, a first end wall, a second end wall, a back wall and an open front wall;

said walls of said main housing defining an interior compartment;

wheels on said bottom wall of said main housing whereby the work station may be moved from one location to another;

a filter assembly positioned at said front wall of said main housing which filters air drawn into said main housing through said front wall thereof;

said top wall of said main housing having an air exhaust opening formed therein;

a fan and motor housing, having open upper and lower ends, selectively removably secured to said top wall of said main housing and extending upwardly therefrom;

said open lower end of said fan and motor housing communicating with said exhaust opening in said top wall of said main housing;

a fan and motor assembly positioned in said fan and motor housing which draws air upwardly from said main housing through said exhaust opening in said top wall thereof and forces the air outwardly through said open upper end of said fan and motor housing;

a transition housing having open upper and lower ends;

said lower end of said transition housing being selectively removably secured to said upper end of said fan and motor housing and extending upwardly therefrom;

an exhaust housing having an open lower end and an upper exhaust opening;

said open lower end of said exhaust housing being selectively removably secured to said upper end of said transition housing;

a filter assembly at said exhaust opening of said exhaust housing;

a divider wall in said main housing which extends between said walls thereof to define an air compartment and a ballast compartment;

said air compartment extending between said open front wall of said main housing and said exhaust opening in said top wall of said main housing;

said back wall of said main housing having at least one opening formed therein which communicates with said ballast compartment to enable ballast material to be placed in said ballast compartment;

a drape support framework is secured to said main housing and extends upwardly therefrom;

a drape assembly is selectively removably attached to said drape support framework.

2. The portable work station of claim 1 wherein a plurality of post supports are selectively removably secured to said main housing and wherein said drape support framework includes a plurality of vertically disposed posts which are removably secured to said post supports.

3. The portable work station of claim 2 wherein at least a pair of said post supports are selectively removably secured to said back wall of said main housing at the outer surface thereof.

4. The portable work station of claim 1 wherein said wheels are secured to support channels which are selectively removably secured to said bottom wall.

5. A portable work station, comprising:

a main housing having a bottom wall, a top wall, a first end wall, a second end wall, a back wall and an open front wall;

said walls of said main housing defining an interior compartment;

wheels on said bottom wall of said main housing whereby the work station may be moved from one location to another;

a filter assembly positioned at said front wall of said main housing which filters air drawn into said main housing through said front wall thereof;

said top wall of said main housing having an air exhaust opening formed therein;

a fan and motor housing, having open upper and lower ends, secured to said top wall of said main housing and extending upwardly therefrom;

said open lower end of said fan and motor housing communicating with said exhaust opening in said top wall of said main housing;

a fan and motor assembly positioned in said fan and motor housing which draws air upwardly from said main housing through said exhaust opening in said top wall thereof and forces the air outwardly through said open upper end of said fan and motor housing;

a transition housing having open upper and lower ends;

said lower end of said transition housing being secured to said upper end of said fan and motor housing and extending upwardly therefrom;

an exhaust housing having an open lower end and an upper exhaust opening;

said open lower end of said exhaust housing being secured to said upper end of said transition housing;

a filter assembly at said exhaust opening of said exhaust housing;

said top wall of said main housing having first and second spaced-apart openings formed therein adjacent said open front wall;

first and second vertically disposed and horizontally spaced-apart tubular supports, having upper and lower ends, positioned within said interior compartment below said first and second openings, respectively;

said lower ends of said first and second supports being selectively removably secured to said bottom wall of said main housing;

said upper ends of said first and second supports being selectively removably secured to said top wall of said main housing;

first and second hollow sockets selectively removably secured to said top wall of said main housing so as to register with said first and second openings, respectively, and the upper ends of said first and second supports, respectively;

third and fourth vertically disposed and horizontally spaced-apart tubular supports selectively removably secured to said back wall of said main housing;

said first, second, third and fourth supports adapted to receive drape assembly support posts therein.

6. The portable work station of claim 5 wherein said first, second, third and fourth support posts are selectively removably secured to said first, second, third and fourth supports, respectively.

7. The portable work station of claim 5 wherein said first and second supports have laterally extending flanges at their lower and upper ends which are secured to said bottom wall and said top wall of said main housing, respectively.

8. The portable work station of claim 7 wherein said first and second hollow sockets have upper and lower ends and wherein each of said lower ends of said first and second hollow sockets have a laterally extending flange which is secured to said top wall of said main housing.

9. The portable work station of claim 8 wherein said flanges on said first and second hollow sockets are secured to said flanges on the upper ends of said first and second supports, respectively.

10. The portable work station of claim 5 wherein said wheels are secured to support channels which are selectively removably secured to said bottom wall.

* * * * *